US010867743B2

(12) United States Patent
Sekiguchi et al.

(10) Patent No.: US 10,867,743 B2
(45) Date of Patent: Dec. 15, 2020

(54) COIL COMPONENT

(71) Applicant: TAIYO YUDEN CO., LTD., Chuo-ku, Tokyo (JP)

(72) Inventors: Takayuki Sekiguchi, Takasaki (JP); Ichiro Yokoyama, Takasaki (JP); Masuo Yatabe, Takasaki (JP); Noriyuki Mabuchi, Takasaki (JP); Tomoyuki Oyoshi, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 146 days.

(21) Appl. No.: 15/713,397

(22) Filed: Sep. 22, 2017

(65) Prior Publication Data

US 2018/0096780 A1 Apr. 5, 2018

(30) Foreign Application Priority Data

Sep. 30, 2016 (JP) ..... 2016-193266

(51) Int. Cl.
*H01F 27/29* (2006.01)
*H01F 17/00* (2006.01)
(Continued)

(52) U.S. Cl.
CPC ..... *H01F 27/292* (2013.01); *H01F 17/0013* (2013.01); *H01F 27/2804* (2013.01);
(Continued)

(58) Field of Classification Search
CPC ... H01F 27/292; H01F 27/2804; H01F 27/327
(Continued)

(56) References Cited

U.S. PATENT DOCUMENTS

2005/0179514 A1* 8/2005 Yamamoto ..... H01F 17/0013 336/200
2006/0006972 A1* 1/2006 Tozawa ..... H01F 17/0013 336/200

(Continued)

FOREIGN PATENT DOCUMENTS

JP 09148133 A * 6/1997
JP H11260644 A 9/1999

(Continued)

OTHER PUBLICATIONS

A Notification of Reason for Refusal issued by Korean Intellectual Property Office, dated Oct. 19, 2018, for Korean counterpart application No. 1020170127466.

(Continued)

*Primary Examiner* — Tszfung J Chan
(74) *Attorney, Agent, or Firm* — Law Office of Katsuhiro Arai

(57) ABSTRACT

In an embodiment, a coil component includes: an element body part 10; a coil conductor 36 constituted by first conductors 32 extending along the pair of end faces 16 and orthogonally to a bottom face 14, as well as second conductors 34 extending from one side, to the other side, of the pair of end faces and thereby connecting the multiple first conductors 32; lead conductor parts 38 electrically connected to two ends of the coil conductor, respectively; and a pair of external electrodes 50 electrically connected to the lead conductor parts; wherein at least one end of the coil conductor is electrically connected, via the lead conductor, to the external electrode at a top face 12 of the element body part; and the coil conductor extends from the at least the one end, using a second conductor, along and near the top face.

6 Claims, 11 Drawing Sheets

(51) Int. Cl.
*H01F 27/28* (2006.01)
*H01F 27/32* (2006.01)
*H01F 41/04* (2006.01)

(52) U.S. Cl.
CPC ..... *H01F 27/327* (2013.01); *H01F 41/041* (2013.01); *H01F 2017/002* (2013.01); *H01F 2017/004* (2013.01); *H01F 2027/2809* (2013.01)

(58) Field of Classification Search
USPC ..... 336/200, 232
See application file for complete search history.

(56) References Cited

U.S. PATENT DOCUMENTS

2006/0049905 A1* 3/2006 Maeda ..... H01F 17/0013 336/200
2006/0152319 A1* 7/2006 Tanaka ..... H01F 17/0033 336/200
2013/0120905 A1* 5/2013 Son ..... H01F 17/0033 361/321.2
2013/0257576 A1 10/2013 Arata et al.
2014/0097927 A1 4/2014 Yamamoto et al.
2015/0371754 A1* 12/2015 Im ..... H01F 17/0013 174/260
2015/0371755 A1* 12/2015 Im ..... H01F 27/2804 336/200

FOREIGN PATENT DOCUMENTS

JP 2000182830 A * 6/2000
JP 2000348939 A 12/2000
JP 2001345212 A * 12/2001 ..... H03H 7/0115
JP 2002367833 A 12/2002
JP 2006032430 A 2/2006
KR 1020050025160 A 3/2005
KR 1020050084853 A 8/2005
TW 200644000 A 12/2006
TW 201310474 A 3/2013
WO WO-2009147925 A1 * 12/2009 ..... H01F 17/0033

OTHER PUBLICATIONS

A Notification of Examination Opinions with Search Report issued by Taiwan Intellectual Property Office, dated Mar. 29, 2018, for Taiwan counterpart application No. 106128220.

* cited by examiner

COIL COMPONENT

BACKGROUND

Field of the Invention

The present invention relates to a coil component.

Description of the Related Art

Inductors, each comprising a coil conductor provided in an insulative body of rectangular solid shape, where the coil conductor is electrically connected to the external electrodes provided on the surface of the insulative body, are known. For example, inductors whose external electrodes are provided on the mounting face of the insulative body, with the coil conductor electrically connected to the external electrodes at the mounting face of the insulative body, for the purpose of improving the electrical characteristics, are known (refer to Patent Literature 1, for example). However, such inductors have lower mounting strength because the external electrodes have small surface areas. To prevent the Q-value from dropping while ensuring mounting strength, inductors whose external electrodes are provided on the mounting face (bottom face) of the insulative body in a manner extending to the top face via the end faces, with the coil conductor electrically connected to the external electrodes at the end faces of the insulative body, are known, for example (refer to Patent Literature 2 and Patent Literature 3, for example).

BACKGROUND ART LITERATURES

[Patent Literature 1] Japanese Patent Laid-open No. 2000-348939

[Patent Literature 2] Japanese Patent Laid-open No. Hei 11-260644

[Patent Literature 3] Japanese Patent Laid-open No. 2006-32430

SUMMARY

However, the constitution where the external electrodes extend from the mounting face (bottom face), to the top face, of the insulative body via the end faces, and where the coil conductor is electrically connected to the external electrodes at the end faces of the insulative body, still presents room for improvement of the Q-value.

The present invention was devised in light of the aforementioned problems, and its object is to improve the Q-value.

Any discussion of problems and solutions involved in the related art has been included in this disclosure solely for the purposes of providing a context for the present invention, and should not be taken as an admission that any or all of the discussion were known at the time the invention was made.

The present invention is a coil component comprising: an element body part constituted by an insulative body of rectangular solid shape; a coil conductor of spiral shape which is provided inside the element body part, which has a coil axis running roughly in parallel with a first face, and a pair of end faces roughly vertical to the first face, of the element body part, and which includes multiple first conductors running along the pair of end faces, respectively, and extending in a direction roughly vertical to the first face, as well as multiple second conductors extending from one side, to the other side, of the pair of end faces and thereby connecting the multiple first conductors; lead conductors which are electrically connected to the two ends of the coil conductor, respectively, and led from the inside to the outside of the element body part; a pair of external electrodes which are provided in a manner extending from the first face, to a second face opposing the first face, via the pair of end faces, of the element body part, and which are electrically connected to the lead conductors; and a marker part which is provided in any one face of the element body part except for the first face; wherein, of the two ends of the coil conductor, at least one end is electrically connected, via the lead conductor, to the external electrode at the second face of the element body part; and wherein the coil conductor extends from at least the one end, by way of the second conductors, along the second face of the element body part.

Under the aforementioned constitution, a constitution may be adopted whereby both of the two ends of the coil conductor are electrically connected to the external electrodes at the second face of the element body part via the lead conductors, while the coil conductor extends from the two ends along the second face of the element body part by way of the second conductors.

Under the aforementioned constitution, a constitution may be adopted whereby one end of the two ends of the coil conductor is electrically connected to the external electrode at the second face of the element body part (referred to also as insulative body) via the lead conductor, while the other end is electrically connected to the external electrode at the first face of the element body part via the lead conductor, and the coil conductor extends from the one end to the second face of the element body part by way of the second conductors.

Under the aforementioned constitution, a constitution may be adopted whereby the lead conductors are each connected to an external electrode over a section of roughly circular shape.

Under the aforementioned constitution, a constitution may be adopted whereby the pair of external electrodes are provided on the pair of end faces of the element body part at least in areas opposing the multiple first conductors.

Under the aforementioned constitution, a constitution may be adopted whereby the marker part is provided on the second face of the element body part.

According to the present invention, the Q-value can be improved.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1A is an oblique perspective view of the inductor pertaining to Example 1, while

FIG. 7A is an oblique perspective view for explaining the flow direction of current through the inductor pertaining to Example 1, while

DESCRIPTION OF THE SYMBOLS

Figure 1A:
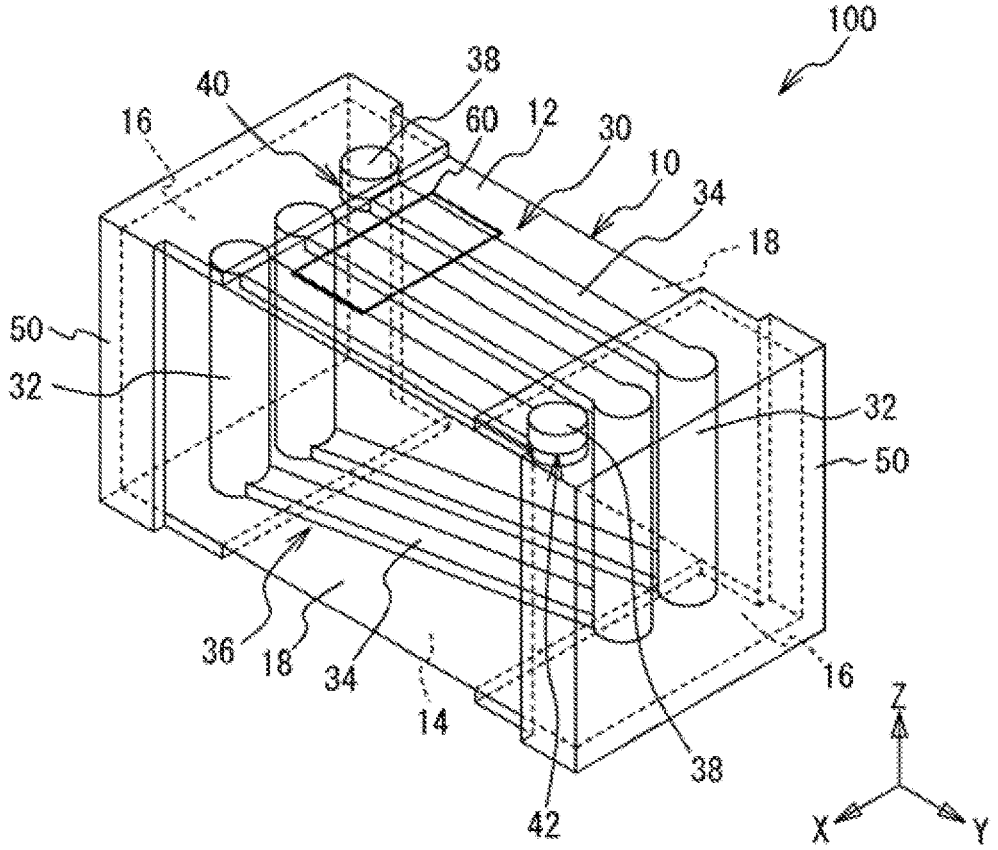

10 Element body part (Insulative body)
12 Top face
14 Bottom face
16 End face
18 Side face
20 to 24 Insulative layer
30 Internal conductor
32 First conductor (Columnar conductor)
34 Second conductor (Coupling conductor)
36 Coil conductor
38 Lead conductor (also referred to as "connecting conductor")
40, 42 End
50 External electrode
60 Marker part
100 to 210 Inductor

DETAILED DESCRIPTION OF EMBODIMENTS

Examples of the present invention are explained below using the drawings.

EXAMPLE 1

Figure 1B:
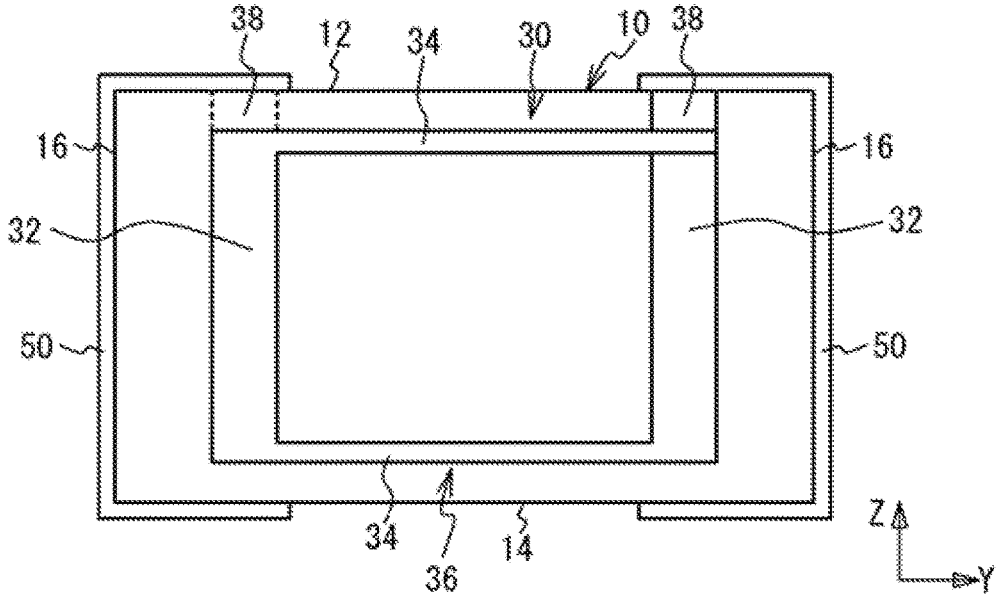
FIG. 1B is a cross-sectional side view of the inductor pertaining to Example 1.

FIG. 1A is an oblique perspective view of the inductor pertaining to Example 1, while FIG. 1B is a cross-sectional side view of the inductor pertaining to Example 1. As shown in FIGS. 1A and 1B, an inductor 100 in Example 1 has an element body part 10, an internal conductor 30, and external electrodes 50.

The element body part 10 has a top face 12 representing a second face, a bottom face 14 representing a first face, a pair of end faces 16, and a pair of side faces 18, and constitutes a rectangular solid shape having sides running in the X-axis direction representing the width direction, Y-axis direction representing the length direction, and Z-axis direction representing the height direction, respectively. The bottom face 14 is a mounting face, while the top face 12 is opposing the bottom face 14. The end faces 16 are each connected to a pair of sides (such as short sides) of the top face 12 and bottom face 14, while the side faces 18 are each connected to a pair of sides (such as long sides) of the top face 12 and bottom face 14. The element body part 10 has a width dimension of 0.05 mm to 0.3 mm, a length dimension of 0.1 mm to 0.6 mm, and a height dimension of 0.05 mm to 0.5 mm, for example. It should be noted that the element body part 10 is not limited to a perfect rectangular solid shape; instead, it may be a roughly rectangular solid shape whose apexes are respectively rounded or whose faces are respectively curved, or the like. In other words, the term "rectangular solid shape" includes a roughly rectangular solid shape like any of the ones described above. It should be noted that the respective apexes may be rounded to a radius of curvature R corresponding to less than 20% of the length of the short side of the element body part 10. The respective faces may have a smoothness of 30 μm or less in surface roughness within one plane for the sake of mounting stability on a mounting board.

The element body part 10 is formed by an insulative material whose primary component is glass, for example. It should be noted that the element body part 10 may be formed by a magnetic material using ferrites, dielectric ceramics or soft magnetic alloy grains, or a resin into which magnetic powder has been mixed. The element body part 10 may also be formed by an insulative material primarily constituted by a resin that hardens due to heat, light, chemical reaction, etc. Examples of such resin include polyimides, epoxy resins, and liquid crystal polymers. Also, the element body part 10 may contain aluminum oxide or other metal oxide and/or silicone oxide ($SiO_2$), as a filler.

The internal conductor 30 is provided inside the element body part 10. The internal conductor 30 has multiple first conductors 32 and multiple second conductors 34, where these multiple first conductors 32 and multiple second conductors 34 are connected together to form a coil conductor 36. To be specific, the coil conductor 36 is constituted as a spiral shape that includes the multiple first conductors 32 and multiple second conductors 34, and it also has specified winding units and a coil axis that crosses roughly at right angles with the faces specified by the winding units. The coil conductor 36 is a functional part that demonstrates the electrical performance of the internal conductor 30.

The multiple first conductors 32 are divided into two conductor groups, each provided on either side of the pair of end faces 16. The first conductors 32 constituting each of the two conductor groups extend in the Z-axis direction, and line up in the X-axis direction with a specified spacing in between. In other words, the multiple first conductors 32 extend in the direction orthogonal to the top face 12 and bottom face 14, along each of the pair of end faces 16. The multiple second conductors 34 are formed in parallel with the XY plane, and are divided into two conductor groups, each provided on either top face 12 side or bottom face 14 side. The second conductors 34 constituting the conductor group on the top face 12 side extend in the Y-axis direction, line up in the X-axis direction with a spacing in between, and connect the opposing first conductors 32 in the Y-axis direction. The second conductors 34 constituting the conductor group on the bottom face 14 side extend diagonally to the Y-axis direction, line up in the X-axis direction with a spacing in between, and connect the opposing first conductors 32 diagonally to the Y-axis direction. In other words, the multiple second conductors 34 extend from one side, to the other side, of the pair of end faces 16 and connect the multiple first conductors 32. Because of the multiple first conductors 32 and multiple second conductors 34, the coil conductor 36, which has a coil axis running roughly in the X-axis direction and whose opening has a rectangular shape, is formed inside the element body part 10. In other words, the coil conductor 36 has a coil axis running roughly in parallel with the bottom face 14 and end faces 16 of the element body part 10, and is orthogonally wound.

The two external electrodes 50, which are external terminals used for surface mounting, are provided in the Y-axis direction in a manner opposing each other. The external electrodes 50 are each provided in a manner extending from the bottom face 14, to the top face 12, via the end face 16, of the element body part 10, while also extending from the end face 16, to the side faces 18, of the element body part. In other words, the external electrodes 50 cover both Y-axis direction ends of the top face 12, bottom face 14, and the side faces 18, while covering the end faces 16, of the element body part 10. Also, the Y-axis direction length of the part of the external electrode 50 covering the side face 18 of the element body part 10 is shorter than the Y-axis direction length of the part of the external electrode 50 covering the top face 12 or bottom face 14 of the element body part 10.

The internal conductor 30 further has lead conductor parts (also referred to as "connecting conductor parts") 38 which are non-functional parts, in addition to the coil conductor 36 which is a functional part and constituted by the multiple first conductors 32 and multiple second conductors 34. The lead conductor parts 38 connect the coil conductor 36 electrically to the external electrodes 50. Ends 40, 42 of the coil conductor 36 are both electrically connected to the external electrodes 50 at the top face 12 of the element body part 10 via the lead conductor parts 38. The lead conductor parts 38 are each connected to an external electrode 50 over a section of roughly circular shape. It should be noted that the term "roughly circular shape" includes not only a perfect circular shape, but also a shape of partially distorted circle, oval shape, etc.

The coil conductor 36 extends from the ends 40, 42, by means of the second conductors 34, along the top face 12 of the element body part 10 between the pair of end faces 16. In other words, the coil conductor 36 does not extend from the ends 40, 42 toward the bottom face 14 along the end faces 16 of the element body part 10.

The internal conductor 30 is formed by copper (Cu), aluminum (Al), nickel (Ni), silver (Ag), platinum (Pt), or palladium (Pd) or other metal material or alloy metal material containing the foregoing, for example. The external electrodes 50 are each formed by silver (Ag), copper (Cu), aluminum (Al), nickel (Ni), or other metal material, or by layered films constituted by silver (Ag), copper (Cu), or aluminum (Al), with nickel (Ni) plating and tin (Sn) plating, or by layered films constituted by nickel (Ni) with tin (Sn) plating, for example.

The element body part 10 has a marker part 60 on the top face 12. The marker part 60 may be constituted by dispersing manganese (Mn), molybdenum (Mo), cobalt (Co), or other oxide metal grains in glass, epoxy, silicone, or other resin. It should be noted that, although the marker part 60 may be provided on any face of the element body part 10 other than the top face 12, it is generally not provided on the bottom face 14 which becomes a mounting face. This is because checking the marker part 60 from the outside becomes difficult after mounting. The marker part 60 allows for clear identification of the direction of the element body part 10.

Figure 2:
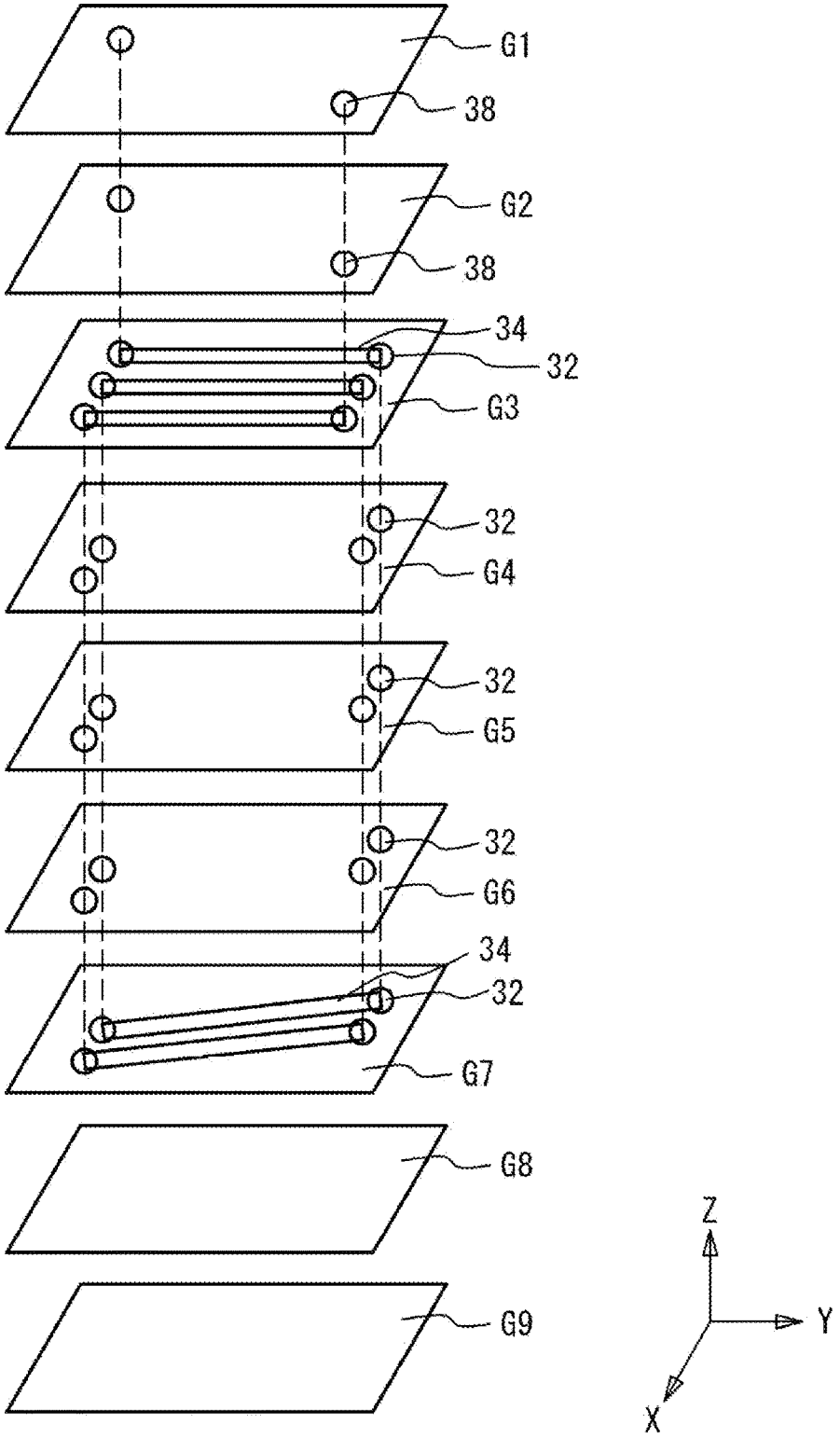
FIG. 2 is a perspective view illustrating a method for manufacturing the inductor pertaining to Example 1.

Next, a method for manufacturing the inductor 100 in Example 1 is explained. FIG. 2 is a perspective view illustrating a method for manufacturing the inductor pertaining to Example 1. As shown in FIG. 2, green sheets G1 to G9 are prepared as precursors of the insulative layers which will constitute the element body part 10. The green sheets are each formed by applying an insulative material slurry whose primary ingredient is glass, etc., onto a film, using the doctor blade method, etc. The thickness of the green sheet is not limited in any way, and it may be between 5 μm and 60 μm, for example, 20 μm.

Through holes are formed by means of laser processing, etc., in specified positions, or specifically positions where the lead conductor parts 38 are to be formed, in the green sheets G1, G2. Similarly, through holes are formed by means of laser processing, etc., in specified positions, or specifically positions where the first conductors 32 and second conductors 34 are to be formed, in the green sheets G3, G7, as well as in specified positions, or specifically positions where the first conductors 32 are to be formed, in the green sheets G4 to G6. Then, a printing method is used to fill a conductive material in the through holes formed in the green sheets G1, G2, to form the lead conductor parts 38, and also a printing method is used to fill a conductive material in the through holes formed in the green sheets G3 to G7, to form the first conductors 32 and second conductors 34. The primary component of the conductive material may be copper (Cu), aluminum (Al), nickel (Ni), silver (Ag), platinum (Pt), palladium (Pd), or other metal material or alloy metal material containing the foregoing, for example.

Next, the green sheets G1 to G9 are stacked in a specified order, and pressure is applied in the stacking direction to pressure-bond the green sheets. Thereafter, the pressure-bonded green sheets are cut to individual chips, which are then sintered at a specified temperature (such as 700° C. to 900° C.), to form element body parts 10.

Next, external electrodes 50 are formed in specified positions on each element body part 10. The external electrodes 50 are formed by applying an electrode paste whose primary component is silver, copper, etc., and then baking the electrode paste at a specified temperature (such as 600° C. to 900° C. or so), followed by electroplating, etc. For this electroplating, copper, nickel, tin, etc., may be used, for example. This way, the inductor 100 in Example 1 is formed.

Figure 3:
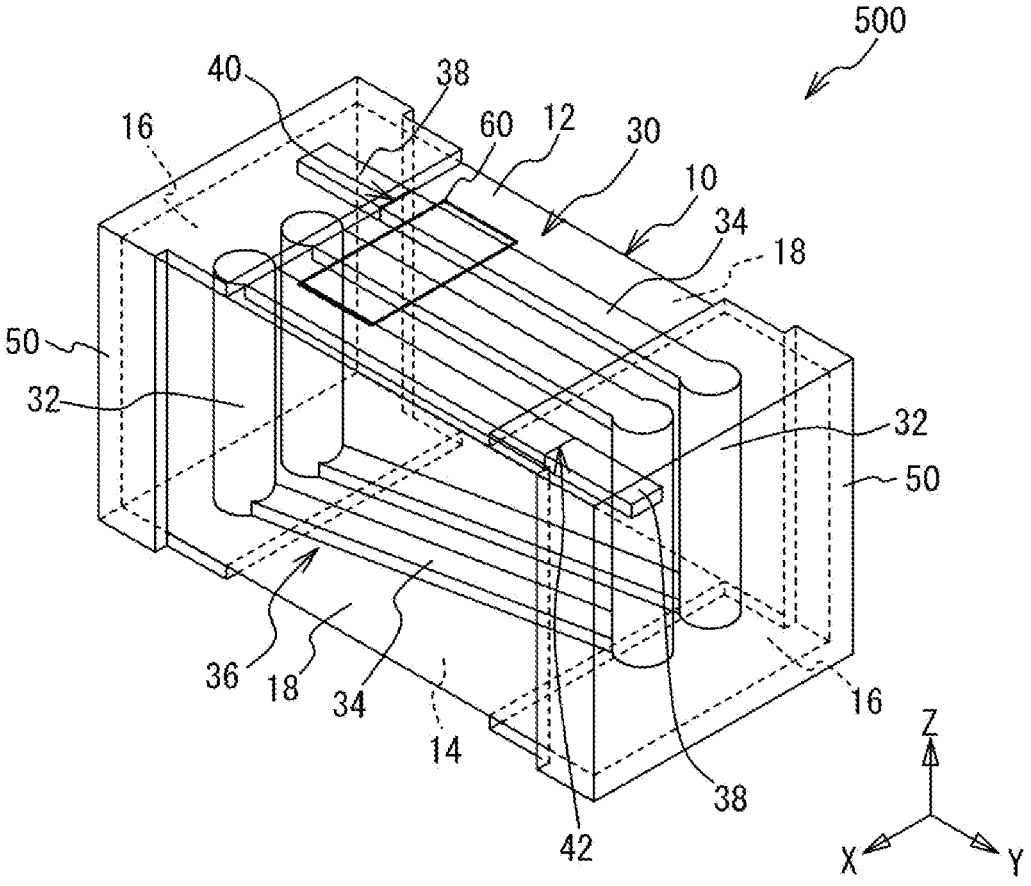
FIG. 3 is an oblique perspective view of the inductor pertaining to Comparative Example 1.

FIG. 3 is an oblique perspective view of the inductor pertaining to Comparative Example 1. As shown in FIG. 3, an inductor 500 in Comparative Example 1 has its coil conductor 36 electrically connected to the external electrodes 50, via the lead conductor parts 38, at positions on the end faces 16, closer to the top face 12, of the element body part 10. The lead conductor parts 38 are each connected to an external electrode 50 over a rectangular shape. The remainder of the constitution is the same as in Example 1 and therefore not explained.

Figure 4:
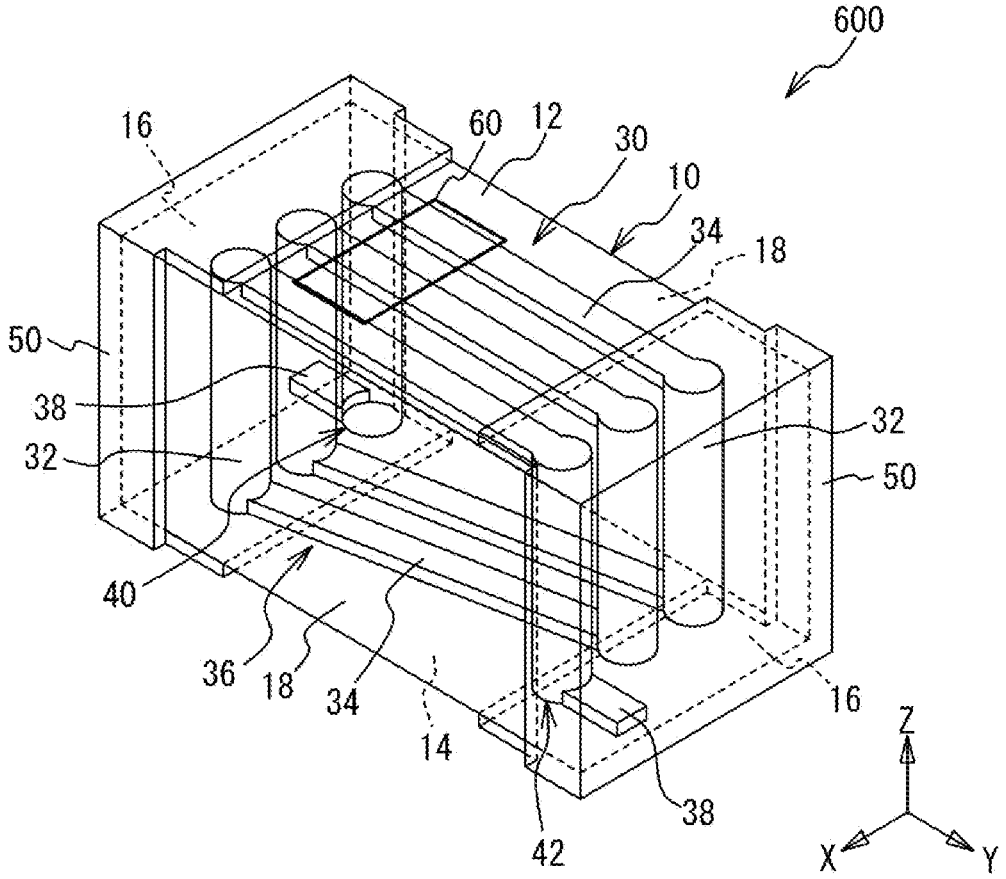
FIG. 4 is an oblique perspective view of the inductor pertaining to Comparative Example 2.

FIG. 4 is an oblique perspective view of the inductor pertaining to Comparative Example 2. As shown in FIG. 4, an inductor 600 in Comparative Example 2 has its coil conductor 36 electrically connected to the external electrodes 50, via the lead conductor parts 38, at positions on the end faces 16, closer to the bottom face 14, of the element body part 10. The lead conductor parts 38 are each connected to an external electrode 50 over a rectangular shape. The remainder of the constitution is the same as in Example 1 and therefore not explained.

Figure 5:
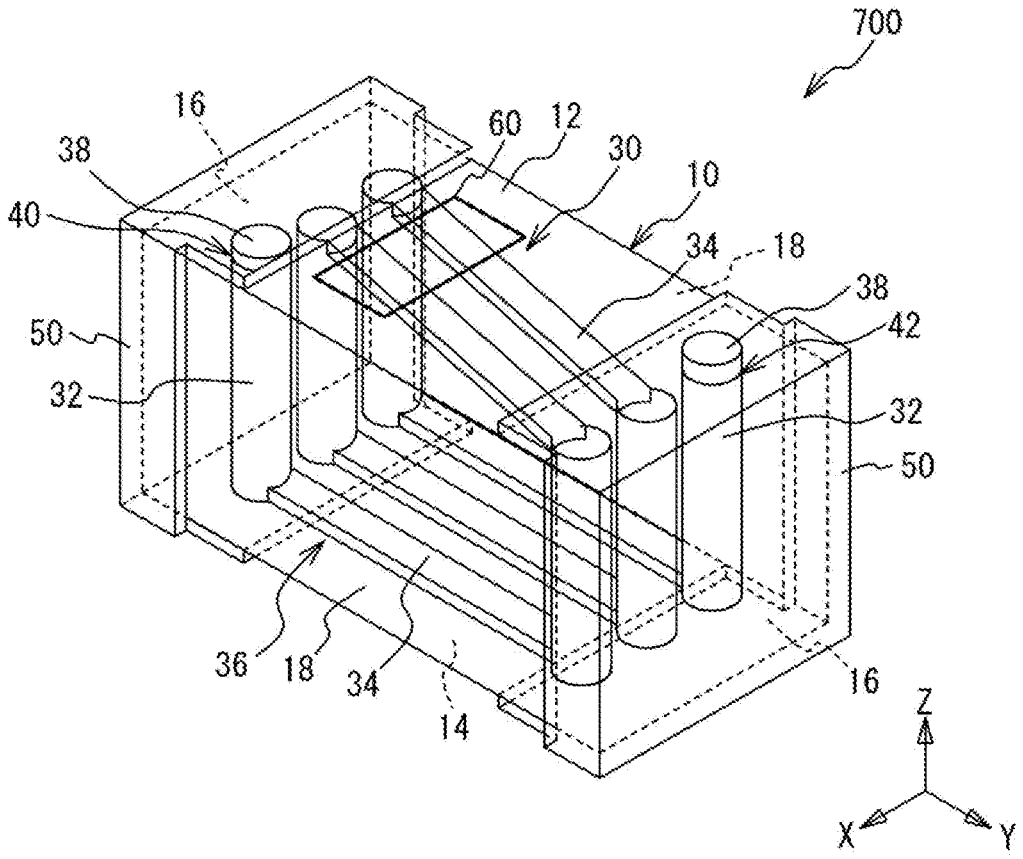
FIG. 5 is an oblique perspective view of the inductor pertaining to Comparative Example 3.

FIG. 5 is an oblique perspective view of the inductor pertaining to Comparative Example 3. As shown in FIG. 5, an inductor 700 in Comparative Example 3 has its coil conductor 36 electrically connected to the external electrodes 50, via the lead conductor parts 38, at the top face 12 of the element body part 10; however, the coil conductor 36 is wound (circling) in the direction opposite to the direction in Example 1. In other words, the coil conductor 36 extends from the ends 40, 42, by means of the first conductors 32, along the end faces 16 of the element body part 10. This means that the coil conductor 36 does not extend from the ends 40, 42 along the top face 12 of the element body part 10. The remainder of the constitution is the same as in Example 1 and therefore not explained.

Now, an electromagnetic field simulation conducted on the inductors in Example 1, Comparative Example 1, Comparative Example 2, and Comparative Example 3 is explained. The simulation was conducted on the inductors of the dimensions below. To be specific, the inductors in Example 1, Comparative Example 1, Comparative Example 2, and Comparative Example 3 have external dimensions of 0.22 mm in width, 0.42 mm in length, and 0.222 mm in height. Also, the multiple first conductors 32 each had a roughly circular section shape of 0.038 mm in diameter, and were each away from the end face 16 of the element body part 10 by 0.04 mm. The multiple second conductors 34 each had a rectangular shape of 0.025 mm in width and 0.01 mm in thickness, and were each away from the top face 12 and bottom face 14 of the element body part 10 by 0.014 mm, respectively. In Example 1 and Comparative Example 3, the lead conductor parts 38 each had a roughly circular section shape of 0.038 mm in diameter, just like the multiple first conductors 32. In Comparative Example 1 and Comparative Example 2, the lead conductor parts 38 each had a rectangular shape of 0.025 mm in width and 0.01 mm in thickness, just like the multiple second conductors 34.

Figure 6:
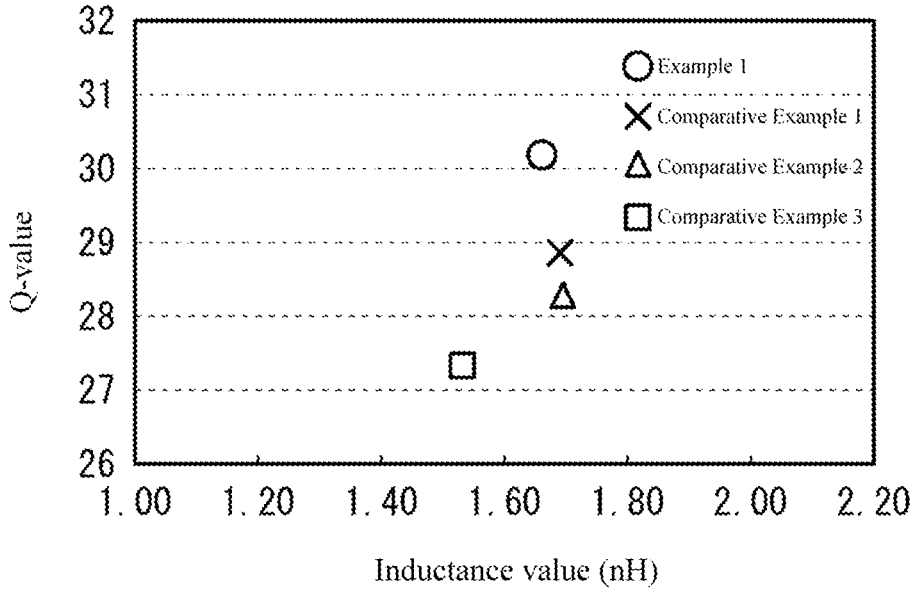
FIG. 6 is a graph showing the results of an electromagnetic field simulation conducted on the inductors pertaining to Example 1, Comparative Example 1, Comparative Example 2, and Comparative Example 3.

FIG. 6 is a graph showing the results of the electromagnetic field simulation conducted on the inductors pertaining to Example 1, Comparative Example 1, Comparative Example 2, and Comparative Example 3. In FIG. 6, the horizontal axis represents the inductance value at 500 MHz, while the vertical axis represents the Q-value at 1800 MHz. As shown in FIG. 6, the Q-value was higher in Example 1 than in Comparative Examples 1 to 3.

The Q-value of the inductor 100 in Example 1 became higher probably because of the reason described below. To be specific, the inductor 500 in Comparative Example 1 has its coil conductor 36 electrically connected to the external electrodes 50, via the lead conductor parts 38, at the end faces 16 of the element body part 10. Under this constitution, the lead conductor parts 38, and the parts of the external electrodes 50 provided on the top face 12 of the element body part 10, are positioned so that they become roughly parallel with each other, and thus form a parallel plate, and therefore a relatively large parasitic capacitance generates. Similarly, the inductor 600 in Comparative Example 2 also generates a relatively large parasitic capacitance between the lead conductor parts 38 and the parts of the external electrodes 50 provided on the bottom face 14 of the element body part 10. In Example 1, on the other hand, the lead conductor parts 38 are connected to the parts of the external electrodes 50 provided on the top face 12 of the element body part 10, from a roughly vertical direction, and therefore the parasitic capacitance can be kept smaller than in Comparative Examples 1 and 2. This is probably why the Q-value became higher in Example 1 than in Comparative Example 1 or Comparative Example 2.

Figure 7A:
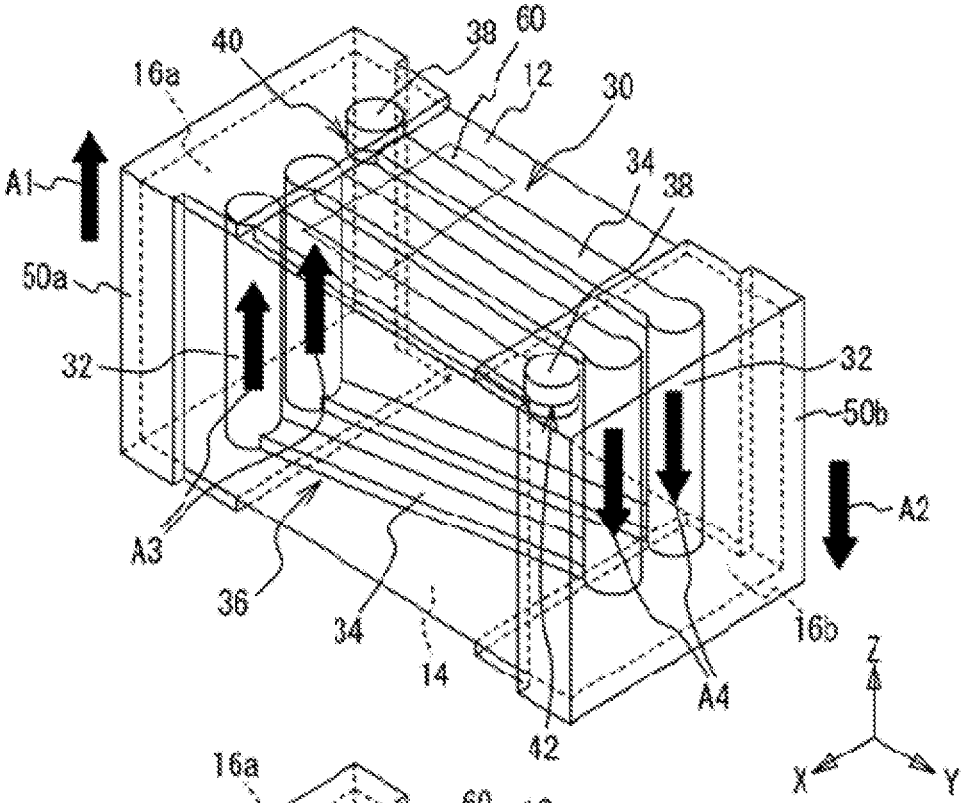
Figure 7B:
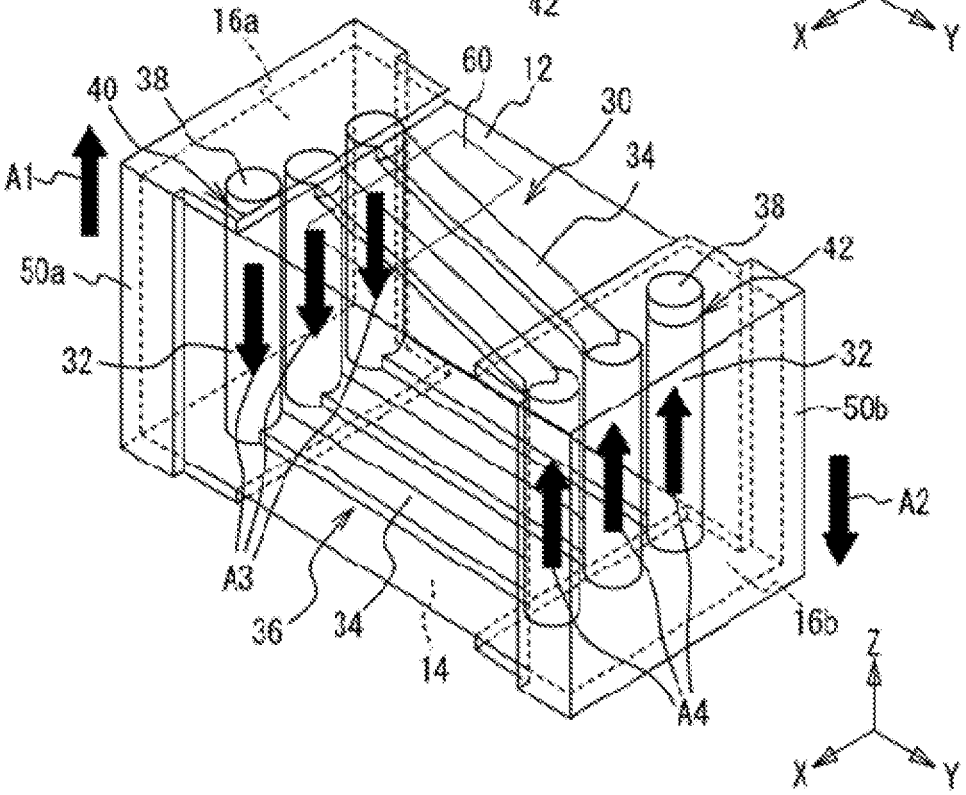
FIG. 7B is an oblique perspective view for explaining the flow direction of current through the inductor pertaining to Comparative Example 3.

On the other hand, the inductor 700 in Comparative Example 3 has its coil conductor 36 electrically connected to the external electrodes 50, via the lead conductor parts 38, at the top face 12 of the element body part 10, just like the inductor 100 in Example 1. However, the Q-value in Example 1 was higher than in Comparative Example 3. This is probably because of the reason described below. FIG. 7A is an oblique perspective view explaining the flow direction of current in the inductor pertaining to Example 1, while FIG. 7B is an oblique perspective view explaining the flow direction of current in the inductor pertaining to Comparative Example 3. It should be noted that, in FIGS. 7A and 7B, the external electrode on the input side is referred to as "external electrode 50*a*," while the external electrode on the output side is referred to as "external electrode 50*b*." Additionally, of the pair of end faces 16 of the element body part 10, the end face on which the external electrode 50*a* is provided is referred to as "end face 16*a*," while the end face on which the external electrode 50*b* is provided is referred to as "end face 16*b*."

As shown in FIG. 7A, the bottom face 14 of the element body part 10 is a mounting face, while the ends 40, 42 of the coil conductor 36 are electrically connected to the external electrode 50*a*, 50*b* at the top face 12 of the element body part 10. This means that, in the external electrode 50*a*, current A1 flows from the bottom face 14 side, to the top face 12 side, of the element body part 10. In the external electrode 50*b*, current A2 flows from the top face 12 side, to the bottom face 14 side, of the element body part (insulative body) 10.

Also, the coil conductor 36 extends from the ends 40, 42, by means of the second conductors 34, along the top face 12 of the element body part 10. This means that, in the first conductors 32 provided along the end face 16*a* of the element body part 10, current A3 flows from the bottom face 14 side, to the top face 12 side, of the element body part 10. In the first conductors 32 provided along the end face 16*b* of the element body part 10, current A4 flows from the top face 12 side, to the bottom face 14 side, of the element body part 10.

This means that, on the end face 16*a* side of the element body part 10, the flow direction of current A1 in the external electrode 50*a* is the same as the flow direction of current A3 in the first conductors 32. As a result, the magnetic field generated by current A1 couples with the magnetic field generated by current A3. Similarly, on the end face 16*b* side of the element body part 10, the flow direction of current A2 in the external electrode 50*b* is the same as the flow direction of current A4 in the first conductors 32, and consequently the magnetic field generated by current A2 couples with the magnetic field generated by current A4.

On the other hand, the inductor 700 in Comparative Example 3 has its coil conductor 36 wound (circling) in the direction opposite to the direction in the inductor 100 of Example 1, and therefore, as shown in FIG. 7B, on the end face 16*a* side of the element body part 10, the flow direction of current A1 in the external electrode 50*a* is opposite to the flow direction of current A3 in the first conductors 32. On the end face 16*b* side of the element body part 10, the flow direction of current A2 in the external electrode 50*b* is opposite to the flow direction of current A4 in the first conductors 32. Accordingly, the magnetic field generated by current A1 and the magnetic field generated by current A3 cancel each other out, while the magnetic field generated by current A2 and the magnetic field generated by current A4 cancel each other out. This is probably why the Q-value in Example 1 became higher than in Comparative Example 3.

It should be noted that, in Comparative Example 2, the lead conductor parts 38 are electrically connected to the external electrodes 50 at positions, closer to the bottom face 14 side, of the end face 16, and this makes it difficult for the current in the inductor to flow through the external electrodes 50 toward the top face 12 side. In other words, the aforementioned magnetic coupling is difficult to occur. This is probably why the Q-value became lower in Comparative Example 2 than in Comparative Example 1.

As described above, in Example 1 the ends 40, 42 of the coil conductor 36 are electrically connected to the external electrodes 50, via the lead conductor parts 38, at the top face 12 of the element body part 10. The coil conductor 36 extends from the ends 40, 42, by means of the second conductors 34, along the top face 12 of the element body part 10. Accordingly, as described above, the parasitic capacitance due to the lead conductor parts 38 can be reduced, while the magnetic fields generated by the currents flowing through the coil conductor 36 and external electrodes 50 can be coupled. As a result, the Q-value can be improved.

In addition, the lead conductor parts 38 are each connected to an external electrode 50 over a roughly circular shape. When the lead conductor parts 38 are each connected to an external electrode 50 over a rectangular shape, as in Comparative Example 1, the sintering step in the inductor production process may cause the lead conductor part 38 to get crushed and become thinner and/or it may cause the lead conductor part 38 to concave inward from the surface of the element body part 10 due to a shrinkage difference between the element body part 10 and the lead conductor part 38. In this case, the lead conductor part 38 and the external electrode 50 may not be connected to each other electrically. When the lead conductor parts 38 are each connected to an external electrode 50 over a roughly circular section shape, on the other hand, it becomes difficult for the aforementioned phenomenon to occur and therefore the reliability of connection between the lead conductor part 38 and the external electrode 50 can be improved.

In addition, the external electrodes 50 are provided at least in areas, of the pair of end faces 16 of the element body part 10, opposing the multiple first conductors 32. This increases the coupling of the magnetic field generated by the current flowing through the external electrode 50 and the magnetic field generated by the current flowing through the first conductors 32, and the Q-value improvement effect increases as a result. It should be noted that, to achieve greater magnetic coupling, the external electrodes 50 are provided preferably in a manner covering the entire surfaces of the pair of end faces 16 of the element body part 10, or more preferably in a manner covering the entire surfaces of the pair of end faces 16 but not extending to the pair of side faces 18.

Also, the external electrodes 50 are provided in a manner extending from the bottom face 14, to the top face 12, via the end faces 16, of the element body part 10. This way, when the inductor 100 in Example 1 is mounted on a mounting board using solder, solder fillets easily wet and spread on the parts of the external electrodes 50 provided on the end faces 16 and top face 12 of the element body part 10. As a result, the solder joint area increases and the mounting strength of the inductor 100 can be improved. It should be noted that, to increase the solder joint area, the external electrodes 50 may also extend from the end faces 16 to the side faces 18.

Figure 8A:
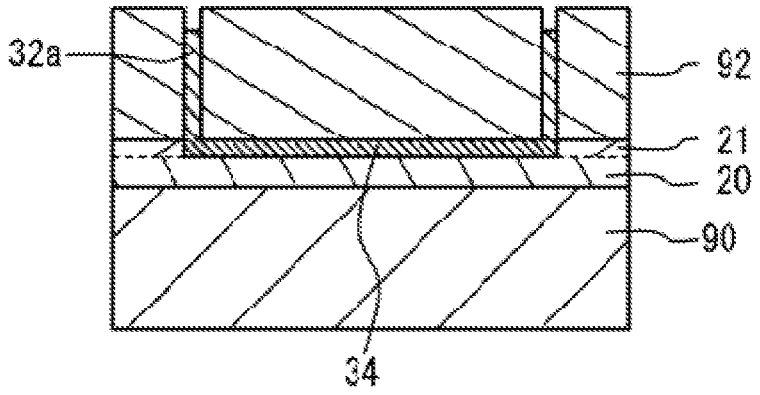
FIG. 8A to FIG. 8C are cross-sectional views (part 1) illustrating another method for manufacturing the inductor pertaining to Example 1.

FIGS. 8A through 9C are cross-sectional views illustrating another method for manufacturing the inductor pertaining to Example 1. As shown in FIG. 8A, an insulative layer 20 is formed on a silicone board, glass board, sapphire board, or other support board 90 by, for example, printing or coating a resin material or adhering a resin film thereon. On the insulative layer 20, a second conductor 34 is formed according to the sputtering method, while an insulative layer 21 covering the second conductor 34 is formed. The insulative layer 21 is formed by printing or coating a resin material or adhering a resin film. Thereafter, the insulative layer 21 is polished to expose the surface of the second conductor 34 (a part of the insulative layer 21 surrounding the periphery of the second conductor 34 remains). Next, a seed layer (not illustrated) is formed on the remaining part of the insulative layer 21, after which a resist film 92 with openings is formed on the seed layer. After the resist film 92 has been formed, a descum process may be performed to remove the residual resist in the openings. Thereafter, first parts 32*a* of the first conductors 32 are formed in the openings in the resist film 92 according to the electroplating method.

Figure 8B:
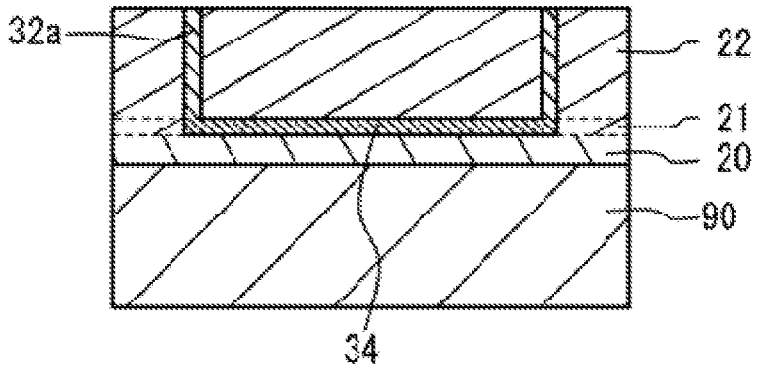

As shown in FIG. 8B, the resist film 92 and seed layer are removed, and then an insulative layer 22 covering the first parts 32*a* of the first conductors 32 is formed. The insulative layer 22 is formed by printing or coating a resin material or adhering a resin film. Thereafter, the insulative layer 22 is polished to expose the surfaces of the first parts 32*a* of the first conductors 32.

Figure 8C:
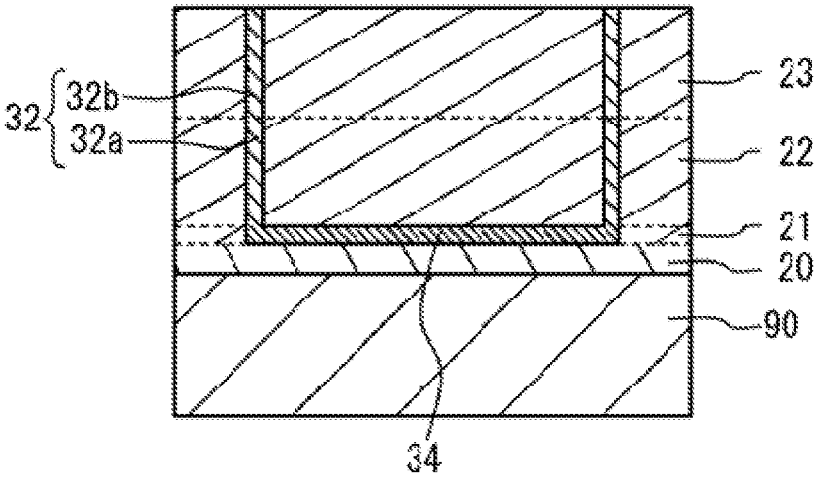

As shown in FIG. 8C, second parts 32*b* of the first conductors 32, and an insulative layer 23 covering the second parts 32*b* of the first conductors 32, are formed on the insulative layer 22. The second parts 32*b* of the first conductors 32 are formed in a manner connecting to the first parts 32*a* of the first conductors 32. The second parts 32*b* of the first conductors 32, and the insulative layer 23, are formed according to a method similar to the one used for the first parts 32*a* of the first conductors 32, and the insulative layer 22.

Figure 9A:
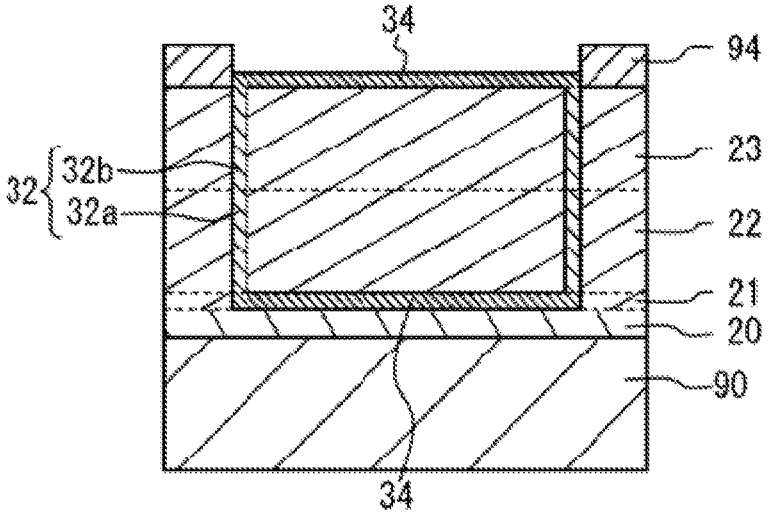
FIG. 9A to FIG. 9C are cross-sectional views (part 2) illustrating another method for manufacturing the inductor pertaining to Example 1.

As shown in FIG. 9A, a seed layer (not illustrated), and a resist film 94 with openings, are formed on the insulative layer 23, and second conductors 34 are formed in the openings in the resist film 94 according to the electroplating method.

Figure 9B:
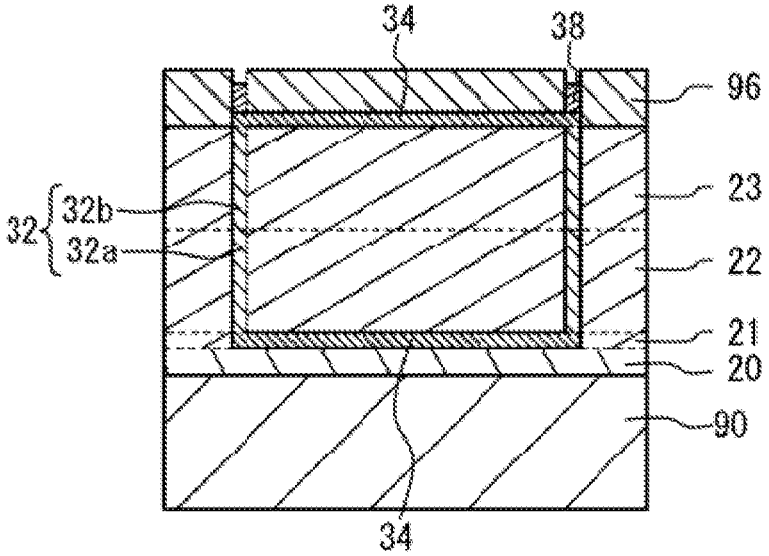

As shown in FIG. 9B, the resist film 94 is removed, after which a resist film 96 with openings is formed again, and lead conductor parts 38 are formed in the openings in the resist film 96 according to the electroplating method.

Figure 9C:
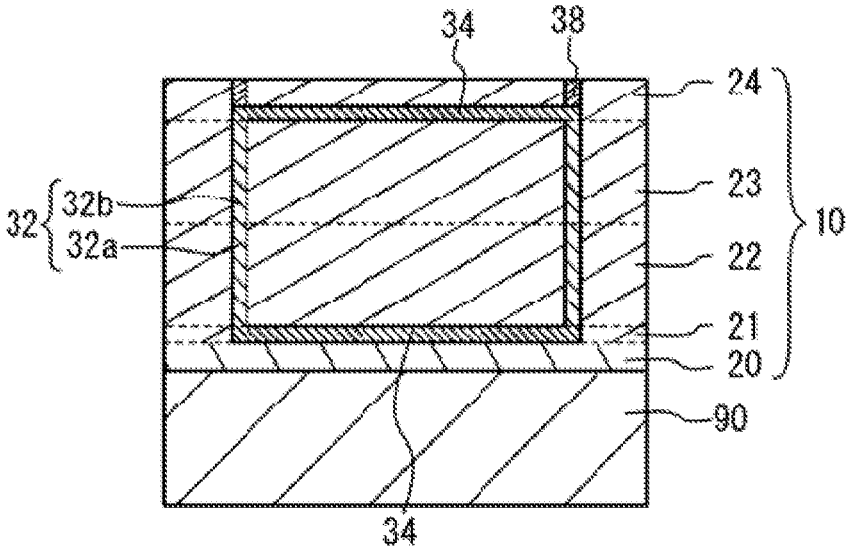

As shown in FIG. 9C, the resist film 96 and seed layer are removed, after which an insulative layer 24 covering the second conductors 34 and lead conductor parts 38 is formed on the insulative layer 23. As the insulative layers 20 to 24 are stacked, an element body part 10 is formed. Thereafter, the element body part 10 is separated from the support board 90, and then external electrodes 50 are formed on the surface of the element body part 10. The inductor 100 in Example 1 is thus formed.

It should be noted that, in Example 1, the manufacturing method is not limited to the aforementioned method and any manufacturing method may be used so long as it can achieve the structure of the inductor 100 in Example 1, and a manufacturing method consisting of a combination of multiple methods may also be used.

EXAMPLE 2

Figure 10:
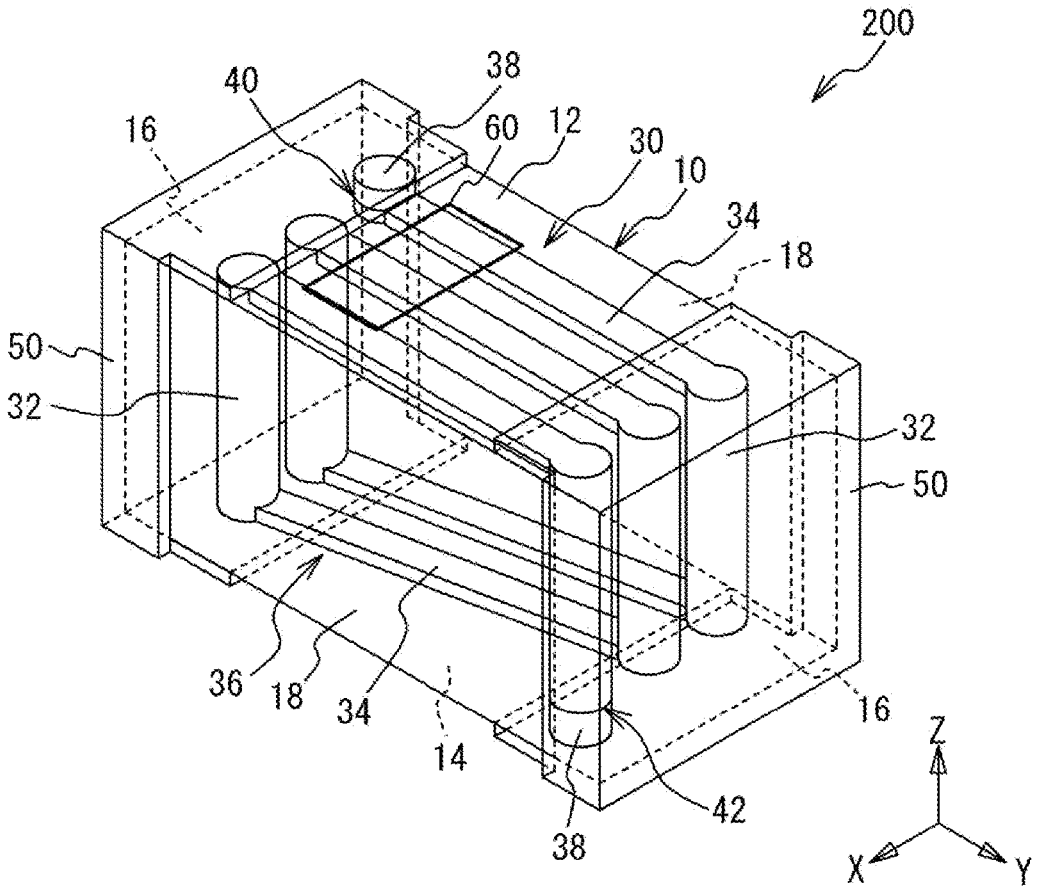
FIG. 10 is an oblique perspective view of the inductor pertaining to Example 2.

FIG. 10 is an oblique perspective view of the inductor pertaining to Example 2. As shown in FIG. 10, an inductor 200 in Example 2 is such that, of the ends 40, 42 of its coil conductor 36, one end 40 is electrically connected to an external electrode 50, via a lead conductor part 38, at the top face 12 of the element body part 10. The other end 42 is electrically connected to an external electrode 50, via a lead conductor part 38, at the bottom face 14 of the element body part 10. The remainder of the constitution is the same as in Example 1 and therefore not explained.

Figure 11:
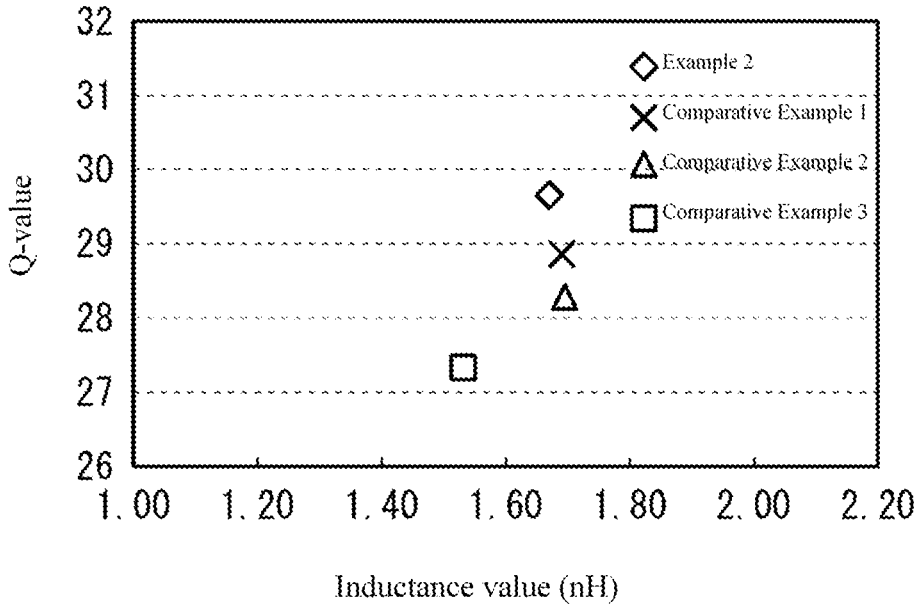
FIG. 11 is a graph showing the results of an electromagnetic field simulation conducted on the inductors pertaining to Example 2, Comparative Example 1, Comparative Example 2, and Comparative Example 3.

FIG. 11 is a graph showing the results of the electromagnetic field simulation conducted on the inductors pertaining to Example 2, Comparative Example 1, Comparative Example 2, and Comparative Example 3. In FIG. 11, the horizontal axis represents the inductance value at 500 MHz, while the vertical axis represents the Q-value at 1800 MHz. It should be noted that the simulation was conducted on the inductors in Example 2, Comparative Example 1, Comparative Example 2, and Comparative Example 3, which had the same dimensions explained using FIG. 6 in Example 1. As shown in FIG. 11, the Q-value was higher in Example 2 than in Comparative Examples 1 to 3. The Q-value of the inductor 200 in Example 2 became higher probably because of the same reason explained in Example 1. To be specific, the smaller parasitic capacitance due to the lead conductor parts 38, and the coupling of the magnetic fields generated by the currents flowing through the coil conductor 36 and the external electrodes 50, probably caused the Q-value to become higher.

Example 2 shows that, of the ends 40, 42 of the coil conductor 36, one end 40 is connected to an external electrode 50, via a lead conductor part 38, at the top face 12 of the element body part 10, while the other end 42 is electrically connected to an external electrode 50, via a lead conductor part 38, at the bottom face 14 of the element body part 10. The coil conductor 36 extends from one end 40, by way of the second conductors 34, along the top face 12 of the element body part 10. This also allows the parasitic capacitance due to the lead conductor parts 38 to decrease, while also allowing the magnetic fields generated by the currents flowing through the coil conductor 36 and the external electrodes 50 to be coupled, and the Q-value can be improved as a result.

Based on Example 1 and Example 2, it suffices that, of the ends 40, 42 of the coil conductor 36, at least one end is electrically connected to an external electrode 50, via a lead conductor part 38, at the top face of the element body part 10. And, it suffices that the coil conductor 36 extends from at least one end, by way of the second conductors 34, along the top face 12 of the element body part 10. This way, the Q-value can be improved.

Figure 12:
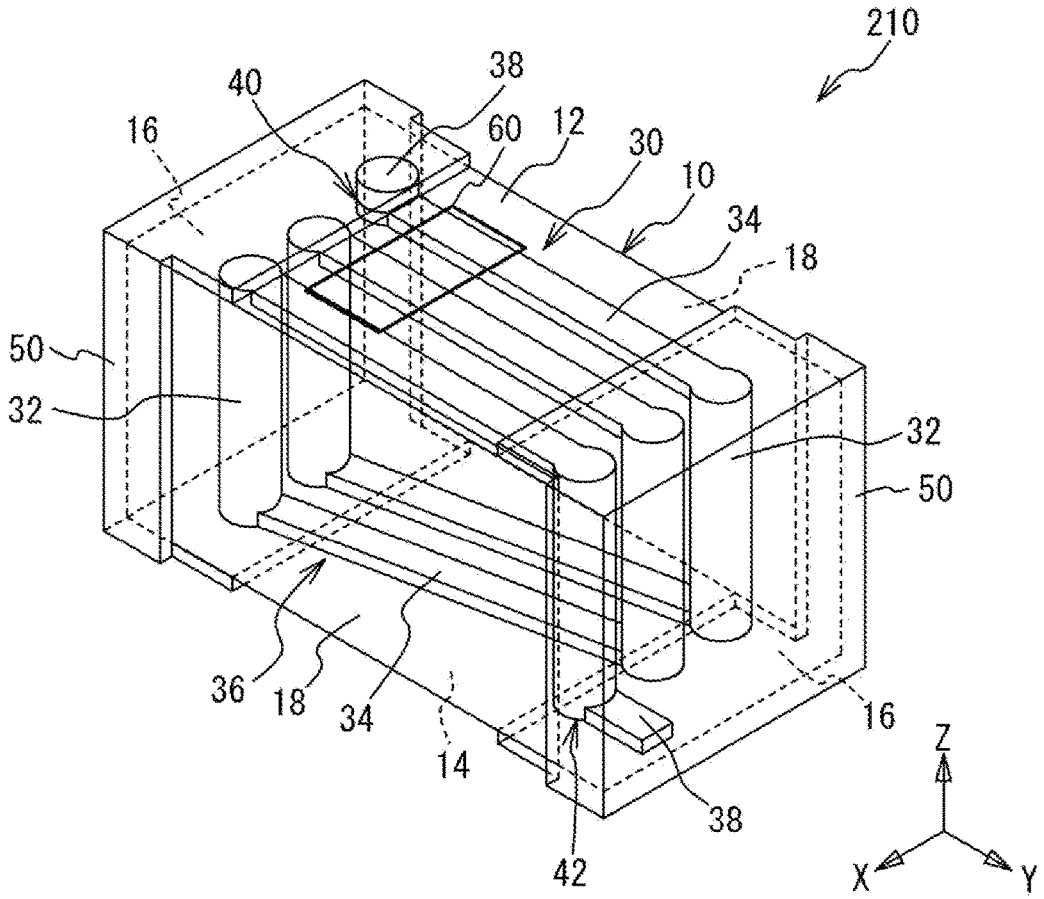
FIG. 12 is an oblique perspective view of the inductor pertaining to Variation Example 1 of Example 2.

FIG. 12 is an oblique perspective view of the inductor pertaining to Variation Example 1 of Example 2. As shown in FIG. 12, an inductor 210 in Variation Example 1 of Example 2 is such that, of the ends 40, 42 of its coil conductor 36, one end 40 is electrically connected to an external electrode 50, via a lead conductor part 38, at the top face 12 of the element body part 10. The other end 42 is electrically connected to an external electrode 50, via a lead conductor part 38, at an end face 16 of the element body part 10. The remainder of the constitution is the same as in Example 1 and therefore not explained.

Example 2 and Variation Example 1 of Example 2 show that, so long as one end 40 of the coil conductor 36 is electrically connected to an external electrode 50, via a lead conductor part 38, at the top face 12 of the element body part 10, then the other end 42 may be electrically connected to an external electrode 50, via a lead conductor part 38, at the bottom face 14 of the element body part 10, or it may be electrically connected to an external electrode 50 at an end face 16. In addition, although not illustrated, the other end 42 may be electrically connected to an external electrode 50, via a lead conductor part 38, on a side face 18.

Figure 13A:
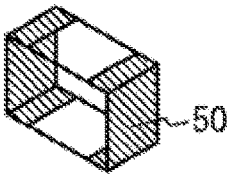
FIG. 13A through FIG. 13D are oblique perspective views showing examples of external electrode shapes.
Figure 13B:
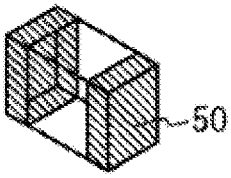
Figure 13C:
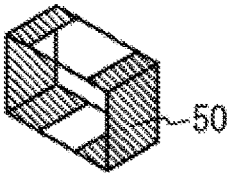
Figure 13D:
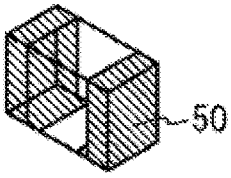

It should be noted that, in Example 1, Example 2, and Variation Example 1 of Example 2, the external electrodes 50 may take various shapes. FIGS. 13A to 13D are oblique perspective views showing examples of external electrode shapes. The external electrodes 50 may be provided in a manner extending from the bottom face to the top face via the end faces as shown in FIG. 13A, or they may extend further onto the side faces as shown in FIG. 13B, or they may occupy a shorter length on the top face than on the bottom face as shown in FIGS. 13C and 13D.

The foregoing described examples of the present invention in detail; however, the present invention is not limited to these specific examples and various modifications and changes are permitted so long as they do not deviate from the purpose of the present invention as described in "What Is Claimed Is."

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-193266, filed Sep. 30, 2016, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component, comprising:

an element body part constituted by an insulative body of rectangular solid shape;

a coil conductor of spiral shape which is provided inside the element body part, which has a coil axis running roughly in parallel with a first face, as well as each of two end faces provided as a pair each roughly orthogonal to the first face, of the element body part, and which is constituted by multiple first conductors running along the pair of end faces, respectively, and extending in a direction roughly orthogonal to the first face, as well as multiple second conductors extending from one side, to another side, of the pair of end faces and thereby connecting the multiple first conductors;

lead conductors which are electrically connected to two ends of the coil conductor, respectively, and led from inside to outside of the element body part;

a pair of external electrodes which are provided in a manner extending from the first face, to a second face opposing the first face, via the pair of end faces, respectively, of the element body part, and which are electrically connected to the lead conductors, respectively, wherein one of the pair of end faces is covered by only one of the pair of external electrodes, among the pair of external electrodes, and another of the pair of end faces is covered by only another of the pair of external electrodes, among the pair of external electrodes; and a marker for directional identification of the element body part, which is provided in any one face of the element body part except for the first face;

wherein, of the two ends of the coil conductor, at least one end is electrically connected, via the lead conductor, to the external electrode at the second face of the element body part;

wherein the coil conductor extends from the at least one end, using part of the second conductors, along and near the second face of the element body part; and wherein the first face is a mounting face which is mounted on a mounting board when in use.

2. A coil component according to claim 1, wherein:

both of the two ends of the coil conductor are electrically connected to the external electrodes, via the lead conductors, at the second face of the element body part; and the coil conductor extends from the two ends, using the part of the second conductors, along and near the second face of the element body part.

3. A coil component according to claim 1, wherein:

of the two ends of the coil conductor, one end which is the at least one end is electrically connected to the external electrode, via the lead conductor, at the second face of the element body part, and another end is electrically connected to the external electrode, via the lead conductor, at the first face of the element body part; and the coil conductor extends from the one end, using part of the second conductors, along and near the second face of the element body part.

4. A coil component according to claim 1, wherein the lead conductors connected to the external electrodes, respectively, each have a cross section of roughly circular shape.

5. A coil component according to claim 1, wherein, on the pair of end faces of the element body part, the pair of external electrodes are provided at least in areas facing the multiple first conductors.

6. A coil component according to claim 1, wherein the marker is provided on the second face of the element body part.

* * * * *